US011118381B2

(12) United States Patent
Nelsen et al.

(10) Patent No.: US 11,118,381 B2
(45) Date of Patent: Sep. 14, 2021

(54) DUAL-PULL LATCH ASSEMBLIES FOR COMPARTMENT CLOSURE ASSEMBLIES OF MOTOR VEHICLES

(71) Applicants: GM Global Technology Operations LLC, Detroit, MI (US); PyeongHwa Automotive Co., Ltd., Daegu (KR)

(72) Inventors: James N. Nelsen, Howell, MI (US); Sung Han Kim, Daegu (KR)

(73) Assignees: GM Global Technology Operations LLC, Detroit, MI (US); PyeongHwa Automotive Co., Ltd., Daegu (KR)

( * ) Notice: Subject to any disclaimer, the term of this patent is extended or adjusted under 35 U.S.C. 154(b) by 766 days.

(21) Appl. No.: 15/914,573

(22) Filed: Mar. 7, 2018

(65) Prior Publication Data

US 2019/0277068 A1 Sep. 12, 2019

(51) Int. Cl.
*E05B 83/24* (2014.01)
*E05B 81/16* (2014.01)
(Continued)

(52) U.S. Cl.
CPC ..... *E05B 83/24* (2013.01); *E05B 79/20* (2013.01); *E05B 81/16* (2013.01); *E05B 85/26* (2013.01);
(Continued)

(58) Field of Classification Search
CPC ..... Y10S 292/14; E05B 83/24; E05B 83/243; Y10T 292/1047
See application file for complete search history.

(56) References Cited

U.S. PATENT DOCUMENTS 3,844,593 A * 10/1974 Slattery ..... E05B 85/247 292/48
4,165,112 A * 8/1979 Kleefeldt ..... E05B 85/045 292/216
(Continued)

FOREIGN PATENT DOCUMENTS

DE 102011003808 A1 * 8/2012 ..... E05B 83/24
DE 102011114148 A1 * 3/2013 ..... E05B 83/24
DE 102014218529 A1 * 3/2016 ..... E05B 77/08

OTHER PUBLICATIONS

Sangil Kim, Seungwoo Seo, Chunghwa Jung, Seunghyun Baek, Changgi Ha, Kiryun Ahn, and Munbae Tak; "Two-Step Hood Opening System Development for Easier Hood Opening Operation"; SAE Technical Paper 2014-01-0363; published Jan. 4, 2014 by SAE International; 6 pages.

*Primary Examiner* — Carlos Lugo
(74) *Attorney, Agent, or Firm* — Quinn IP Law

(57) ABSTRACT

A latch mechanism includes a detent lever attached to a vehicle, and a release lever attached adjacent the detent to move between a pulled position, pushing the detent lever to an unlocked position responsive to activation of a release handle, and a released position, releasing the detent to move to a locked position responsive to deactivation of the release handle. A forkbolt is attached to the vehicle to move between: a first position—engaging the detent, retaining the striker at one location, and latching a compartment closure assembly closed; a second position—disengaging the detent, retaining the striker at another location, and latching the closure assembly in one pop-up position; a third position—reengaging the detent, retaining the striker at yet another location, and latching the closure assembly in another pop-up position; and a fourth position—disengaging the detent and allowing the closure assembly to open.

20 Claims, 3 Drawing Sheets

(51) Int. Cl.
*E05B 79/20* (2014.01)
*E05B 77/04* (2014.01)
*E05B 85/26* (2014.01)

(52) U.S. Cl.
CPC ..... *Y10S 292/14* (2013.01); *Y10T 292/1047* (2015.04)

(56) References Cited

U.S. PATENT DOCUMENTS 4,172,768 A * 10/1979 Cerdan ..... E05B 85/26 292/216
4,203,621 A * 5/1980 Noel ..... E05B 85/26 292/216
4,783,103 A * 11/1988 Schlegel ..... E05B 85/26 292/216
5,150,933 A * 9/1992 Myslicki ..... E05B 83/16 292/216
5,163,723 A * 11/1992 Ruckert ..... E05B 85/26 292/216
5,288,115 A * 2/1994 Inoue ..... E05B 81/20 292/201
5,618,069 A 4/1997 Konchan et al.
5,938,252 A * 8/1999 Uemura ..... E05B 81/14 292/201
6,581,987 B1 * 6/2003 Gentile ..... E05B 83/24 292/216
6,880,870 B2 4/2005 Costigan
7,195,090 B2 3/2007 Parks et al.
7,665,776 B2 2/2010 Lang
8,128,137 B2 3/2012 Takaya et al.
8,182,004 B2 5/2012 Yoda
8,196,507 B2 6/2012 Schafer et al.
8,235,428 B2 * 8/2012 Hunt ..... E05B 77/36 292/216
8,376,424 B2 2/2013 Bejune
8,419,114 B2 4/2013 Fannon et al.
8,469,411 B2 6/2013 Costigan
8,596,180 B2 12/2013 Schaefer et al.
8,646,816 B2 2/2014 Dziurdzia et al.
8,656,716 B2 2/2014 Schafer
9,062,477 B2 6/2015 Da Deppo et al.
9,187,936 B2 * 11/2015 Kim ..... E05B 83/24
9,212,509 B2 * 12/2015 Pettengill ..... E05C 3/12
2002/0096889 A1 7/2002 Nelsen et al.
2006/0006669 A1 1/2006 Nelsen et al.
2006/0226661 A1 * 10/2006 Moore ..... E05B 81/20 292/216
2009/0217809 A1 9/2009 Schafer et al.
2010/0089048 A1 4/2010 Schaefer
2012/0181798 A1 7/2012 Margheritti et al.
2012/0204562 A1 8/2012 Schafer et al.
2014/0319848 A1 * 10/2014 Fannon ..... E05B 83/24 292/122
2014/0361554 A1 * 12/2014 Ferri ..... E05B 83/24 292/200
2017/0306661 A1 * 10/2017 Kim ..... E05B 83/24

* cited by examiner

DUAL-PULL LATCH ASSEMBLIES FOR COMPARTMENT CLOSURE ASSEMBLIES OF MOTOR VEHICLES

INTRODUCTION

The present disclosure relates generally to latching systems for compartment closure assemblies of motor vehicles. More specifically, aspects of this disclosure relate to dual-pull hood latch assemblies for engine hoods, trunk lids, tailgates, etc.

Many current production motor vehicles, such as the modern-day automobile, are originally equipped with compartment closure assemblies that are movably mounted to the vehicle body to provide access to the vehicle's various compartments. In automotive applications, for example, driver-side and passenger-side vehicle doors can be opened and closed to allow user access for entering and exiting the passenger compartment. In contrast, the engine hood (or "bonnet" in some countries) extends over and covers the vehicle's engine compartment to prevent theft or damage of the engine components. A traditional trunk compartment, on the other hand, is a large storage bin typically located at the rear of the vehicle and covered by a trunk lid that is hinged underneath the passenger compartment's rear deck. By comparison, pickup trucks and other cargo transport vehicles (e.g., sport utility vehicles (SUV), cargo vans, box trucks, etc.) may be typified by a rear cargo compartment that is closed off at the tail end of the vehicle by a hinged liftgate, tailgate, or door assembly. Some automobiles—colloquially referred to as "convertibles"—are equipped with a collapsible roof that can be opened for extra sunlight and ventilation for the passenger compartment.

Vehicle compartment closure assemblies oftentimes employ a concealed latching system to secure the compartment closure assembly in a closed position, and to selectively release the compartment closure assembly for movement to an open position. Vehicle engine hoods, for instance, commonly utilize a hood latch assembly for latching the hood in its closed position, a release cable for disengaging the hood latch assembly from the engine hood's striker pin, and a latch release handle operable from inside the passenger compartment for activating the release cable to unlatch the hood latch assembly. One type of hood latch assembly uses a "dual-pull" or "dual-action" configuration with a primary latch that secures the engine hood in a fully-closed position, and a secondary latch that retains the hood at a partly open position under the force of a pop-up spring. This secondary latch is generally provided as a security feature to prevent the hood from inadvertently flying open during vehicle operation should the primary latch not be fully engaged during closing or be inadvertently released by the driver. In order to completely unlatch the engine hood for movement to a full open position, the secondary latch is released through operation of a manual release lever mounted under the hood at a front end of the vehicle.

SUMMARY

Disclosed herein are dual-pull latch mechanisms for compartment closure assemblies of motor vehicles, methods for making and methods for using such dual-pull latch mechanisms, and motor vehicles equipped with a dual-pull hood latch mechanism with self-latching capabilities and memory lever functionality. By way of example, there is presented a dual-pull hood latch system that allows the engine hood to be fully opened using, e.g., two distinct pulls of an interior hood release handle. This will eliminate the need for an under-hood release lever that may be difficult for customers to find and oftentimes has to be redesigned for each vehicle platform, e.g., due to front end-styling variations. In addition, disclosed latch assemblies allow the hood, when closing, to automatically engage a secondary latch under the hood's own weight, thus eliminating the need for a user to apply a large manual closing force. The latch assembly is able to provide the foregoing functionality without incorporating additional packaging space to accommodate added forkbolt pop-up travel for multiple pop-up positions. Moreover, the latch assembly functions without significantly higher spring efforts (i.e., more costly, larger springs and larger closing forces) to ensure that the hood will clear both initial and secondary pop-up positions, e.g., to allow the customer to open the hood when manufacturing tolerances, build variations, snow loads, etc., are taken into account. Disclosed solutions provide these dual-pull features without requiring significantly higher latching forces and closing efforts. Other aspects of the disclosure allow for forkbolt cancellation of the memory lever with an optional park shifter interlock feature.

Continuing with the discussion of the above example, the dual-pull latch assembly utilizes a single forkbolt that is selectively retained in four distinct positions: (1) a first "full" or "primary" latched position; (2) a second "initial pop-up" latched position (e.g., approximately 15-20 mm from full latch); (3) a third "secondary pop-up" latched position located a small displacement further from the primary position than the pop-up position (e.g., approximately 20-25 mm from full latch); and (4) a fourth "full open" position from which the striker escapes from the latch assembly. A memory lever engages the release lever when the forkbolt is transitioning through one or both pop-up positions to maintain the release lever in its pulled position. As the forkbolt moves from the pop-up positions to the full open position, the forkbolt presses against the memory lever and thereby drives the memory lever out of engagement with the release lever. These features allow the hood, when lowered from the open position towards the fully closed position, to relatch into at least the secondary pop-up position under a small load (e.g., less than the weight of the hood itself at the striker). The memory lever may also be connected, e.g., by a cable or other linkage, to an external input that can cancel the memory lever position in the event the vehicle is shifted from park and/or reaches a minimum speed threshold.

This dual-pull hood latch assembly works within the same packaging envelope (e.g., forkbolt engagement/disengagement travel) and spring sizes (e.g., pop-up force and forkbolt spring) as existing non-dual-action hood latch mechanisms. For instance, a partial pop-up of the hood will provide sufficient travel difference to allow the secondary latch to be disengaged by the linkage, thus reducing user effort to latch and unlatch the dual-pull hood latch assembly. A further benefit of disclosed latch system designs includes the hood being automatically engaged into a latched state from its own weight, e.g., if the user merely sets the hood down onto the latch, which provides additional prevention against a user driving with an unsecured hood. Another option would be to mechanically couple the memory lever to an external connection, which may be used to actively cancel the memory lever with movement of the vehicle to ensure that the hood is in a latched position. This may be of particular benefit for autonomous ride share vehicles wherein the operator may not be capable of or present to re-latch the hood based on existing ajar warning devices. Additional advantages may include less mass and reduced costs than a powered closure (cinching) latch solution. The full open position of the forkbolt, e.g., with the addition of another switch, allows the system to detect the difference between the full open position and the secondary pop-up position, which may be used with an autonomous vehicle cancelling feature.

Aspects of the present disclosure are directed to dual-pull compartment closure latch mechanisms with self-latching features and memory-lever-cancelling functionality. For instance, there is presented a latch mechanism for a compartment closure assembly of a motor vehicle. This compartment closure assembly, which may be in the nature of an engine hood, trunk lid, liftgate, tailgate, driver-side or passenger-side door, etc., is movably mounted to the vehicle's body to transition back-and-forth between open and closed positions. The motor vehicle includes a passenger compartment that stows therein a release mechanism, which may be configured as a manually powered release handle, a manually activated electric stepper motor, etc. The latch mechanism includes a detent lever that movably attaches, either directly or indirectly, to the vehicle body, and rotates or otherwise selectively transitions back-and-forth between locked and unlocked positions. In addition, a release lever operatively attaches to the release mechanism, e.g., via a release cable, and movably attaches, either directly or indirectly, to the vehicle body. This release lever rotates or otherwise selectively transitions back-and-forth between pulled and released positions. When moved to the pulled position, e.g., though activation of the release mechanism, the release lever presses against or otherwise moves the detent lever to the unlocked position. Conversely, when moved back to the released position, e.g., upon deactivation of the release mechanism, the release lever releases the detent lever such that the detent lever moves back to the locked position.

The latch mechanism of this example also includes a forkbolt that movably attaches, either directly or indirectly, to the vehicle body adjacent the detent and release levers. This forkbolt rotates or otherwise selectively transitions back-and-forth between: a first (fully latched) position, whereat the forkbolt engages the detent lever, retains the striker at a first location, and latches the compartment closure assembly in the closed position; a second (initial pop-up) position, whereat the forkbolt temporarily disengages the detent lever, retains the striker at a second location distinct from the first location, and latches the compartment closure assembly in a primary pop-up position; a third (secondary pop-up) position, whereat the forkbolt engages the detent lever, retains the striker at a third location distinct from the first and second locations, and latches the compartment closure assembly in an ancillary pop-up position; and a fourth (full open) position, whereat the forkbolt disengages the detent lever and releases the striker such that the compartment closure assembly is movable to the open position.

The latch mechanism may also include a memory lever that attaches, either directly or indirectly, to the vehicle body adjacent the forkbolt and release levers. This memory lever rotates or otherwise selectively transitions back-and-forth between catching and releasing positions. When in the catching position, the memory lever abuts or otherwise engages the release lever so as to catch the release lever in its pulled position and, thus, retain the detent lever in its unlocked position. Conversely, when moved to the releasing position, e.g., via a pin and/or flange projecting from the forkbolt, the memory lever disengages the release lever such that the release lever may transition back to the released position and, thus, allow the detent lever to transition back to its locked position.

Other aspects of the present disclosure are directed to motor vehicles equipped with a dual-pull hood latch system for latching closed and governing the opening of a hood assembly. As used herein, the term "motor vehicle" may include any relevant vehicle platform, such as passenger vehicles (internal combustion engine, hybrid, full electric, fuel cell, fully or partially autonomous, etc.), commercial vehicles, industrial vehicles, tracked vehicles, off-road and all-terrain vehicles (ATV), farm equipment, boats, airplanes, etc. In an example, a motor vehicle is presented that includes a vehicle body with a passenger compartment that is fore or aft of an interior compartment (e.g., an engine bay, trunk, bed, etc.). Covering an access opening to this interior compartment is a closure assembly that is pivotably mounted to the vehicle body. This closure assembly is manually and/or automatically movable between an open position, providing access to the interior compartment, and a closed position, obstructing access to the compartment. A striker, which may include a striker bolt or a U-shaped striker pin, is supported on a striker plate attached to the vehicle body (e.g., in a tailgate or liftgate application) or to the compartment closure assembly (e.g., in a hood latch application). A manually activated release handle or similarly functional device is located inside the passenger compartment.

Continuing with the above example, the motor vehicle is also equipped with a latch mechanism that cooperates with the release handle to selectively latch and unlatch the compartment closure assembly. This latch mechanism includes a mounting bracket that is mounted to the vehicle body (or the closure assembly), and a detent lever that is rotatably mounted on the mounting bracket to rotate between locked and unlocked positions. A release lever is mechanically coupled to the release handle, and selectively rotatable between a pulled position, whereat the release lever moves the detent lever to the unlocked position responsive to activation of the release handle, and a released position, whereat the release lever releases the detent lever to move to the locked position responsive to deactivation of the release handle. A forkbolt is rotatably mounted on the mounting bracket adjacent the detent and release levers. The forkbolt selectively rotate between: a first position—engaging the detent lever, retaining the striker at a first location, and latching the closure assembly in a closed position; a second position—disengaging the detent lever, retaining the striker at a second location, and latching the compartment closure assembly in a primary pop-up position; a third position—engaging the detent lever, retaining the striker at a third location distinct from the first and second locations, and latching the closure assembly in an ancillary pop-up position; and, a fourth position—disengaging the detent lever and releasing the striker such that the compartment closure assembly is movable to the open position. An optional fifth forkbolt position may include a temporary position between the closed and pop-up positions where the secondary latch hook of the forkbolt engages the lower stem portion of the detent; this mating feature may operate to momentarily stop the forkbolt during its rotation towards the fully open position. Yet another option may include the backside of the forkbolt's secondary latch hook seating on the backside of the detent's hook portion when the forkbolt is in the fourth full-open position.

Additional aspects of this disclosure are directed to methods for making and methods for using any of the herein depicted or described vehicle latch assemblies. For instance, a method is presented for assembling a latch mechanism for a compartment closure assembly of a motor vehicle. The representative method includes, in any order and in any combination with any of the disclosed features and options: attaching a detent lever to the vehicle body to move between a locked position and an unlocked position; attaching a release lever to a release mechanism located inside a passenger compartment of the motor vehicle; attaching the release lever to the vehicle body to move between a pulled position, whereat the release lever moves the detent lever to the unlocked position responsive to activation of the release mechanism, and a released position, whereat the release lever releases the detent lever to move to the locked position responsive to deactivation of the release mechanism; and attaching a forkbolt to the vehicle body, adjacent the detent and release levers. The forkbolt selectively rotates from a first distinct position, where the forkbolt engages the detent lever, retains the striker at a first distinct location, and latches the closure assembly in a closed position, to a second distinct position, where the forkbolt disengages the detent lever, retains the striker at a second distinct location, and latches the compartment closure assembly in a primary pop-up position. The forkbolt also selectively rotates from the second position to a third distinct position, where the forkbolt engages the detent lever, retains the striker at a third distinct location, and latches the closure assembly in an ancillary pop-up position, and then to a fourth distinct position, where the forkbolt disengages the detent lever and releases the striker such that the compartment closure assembly may be moved to the open position. The forkbolt is also operable to selectively rotate from the fourth to the first position as well as back-and-forth between any of the above-enumerated positions.

The above summary is not intended to represent every embodiment or every aspect of the present disclosure. Rather, the foregoing summary merely provides an exemplification of some of the novel concepts and features set forth herein. The above features and advantages, and other features and attendant advantages of this disclosure, will be readily apparent from the following detailed description of illustrated examples and representative modes for carrying out the present disclosure when taken in connection with the accompanying drawings and the appended claims. Moreover, this disclosure expressly includes any and all combinations and subcombinations of the elements and features presented above and below.

Figure 1:
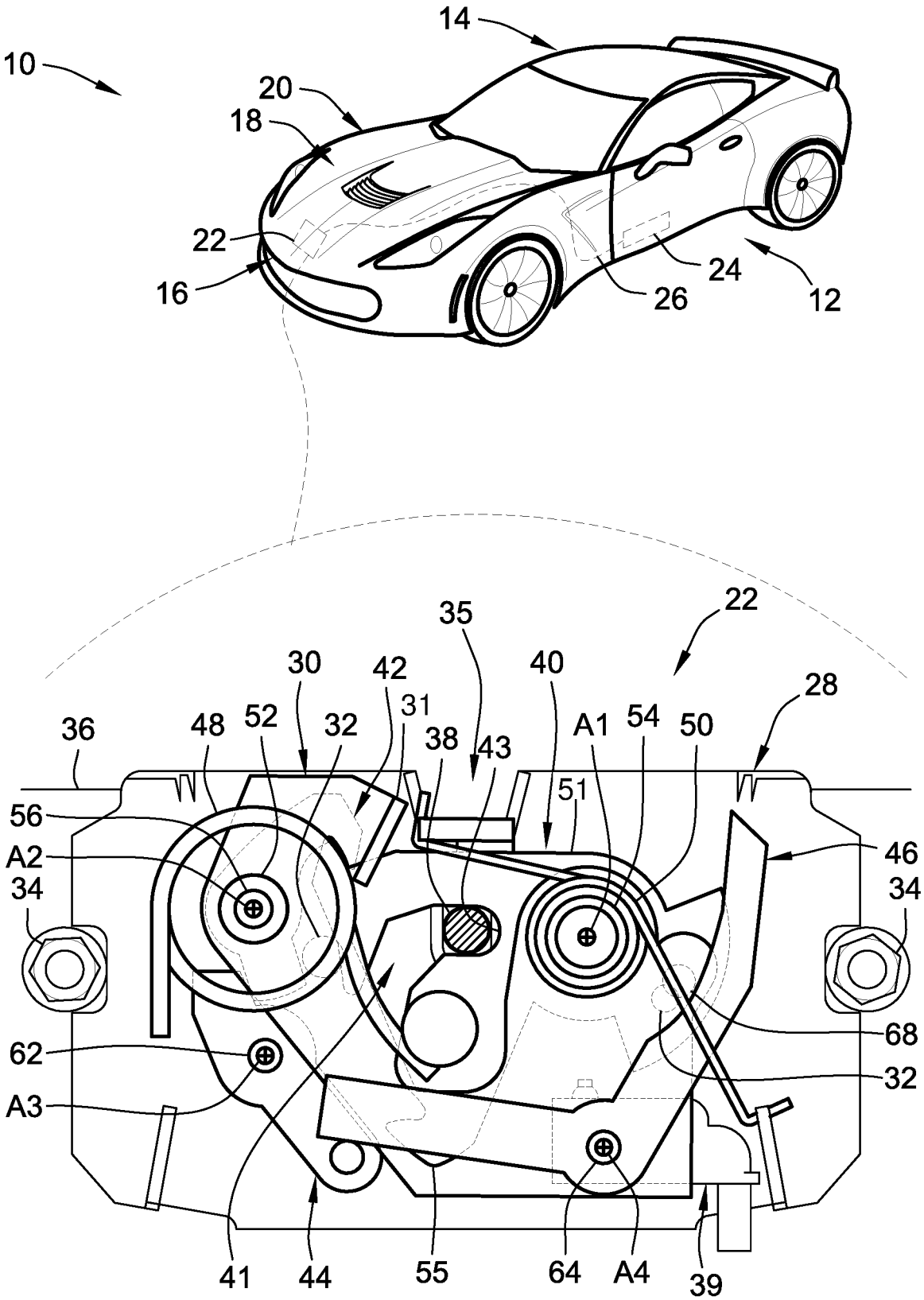
FIG. 1 is a front perspective-view illustration of a representative motor vehicle with an inset view of a representative dual-pull latch assembly illustrated in a fully closed condition in accordance with aspects of the present disclosure.

The present disclosure is amenable to various modifications and alternative forms, and some representative embodiments have been shown by way of example in the drawings and will be described in detail herein. It should be understood, however, that the novel aspects of this disclosure are not limited to the particular forms illustrated in the above-enumerated drawings. Rather, the disclosure is to cover all modifications, equivalents, combinations, subcombinations, permutations, groupings, and alternatives falling within the scope of this disclosure as encompassed by the appended claims.

DETAILED DESCRIPTION

This disclosure is susceptible of embodiment in many different forms. There are shown in the drawings and will herein be described in detail representative embodiments of the disclosure with the understanding that these illustrated examples are provided as an exemplification of the disclosed principles, not limitations of the broad aspects of the disclosure. To that extent, elements and limitations that are described, for example, in the Abstract, Introduction, Summary, and Detailed Description sections, but not explicitly set forth in the claims, should not be incorporated into the claims, singly or collectively, by implication, inference or otherwise.

For purposes of the present detailed description, unless specifically disclaimed: the singular includes the plural and vice versa; the words "and" and "or" shall be both conjunctive and disjunctive; the words "any" and "all" shall both mean "any and all"; and the words "including" and "comprising" and "having" shall each mean "including without limitation." Moreover, words of approximation, such as "about," "almost," "substantially," "approximately," and the like, may be used herein in the sense of "at, near, or nearly at," or "within 0-5% of," or "within acceptable manufacturing tolerances," or any logical combination thereof, for example. Lastly, directional adjectives and adverbs, such as fore, aft, inboard, outboard, starboard, port, vertical, horizontal, upward, downward, front, back, left, right, etc., may be with respect to a motor vehicle, such as a forward driving direction of a motor vehicle when the vehicle is operatively oriented on a normal driving surface, for example.

Referring now to the drawings, wherein like reference numbers refer to like features throughout the several views, there is shown in FIG. 1 a representative automobile, which is designated generally at 10 and portrayed herein for purposes of discussion as a two-seat coupe-style passenger vehicle. Mounted to the body 12 of the vehicle 10, e.g., forward of a vehicle passenger compartment 14 and aft of a front bumper assembly 16, is an engine hood assembly 18 that extends across and covers the upper extent of an engine compartment 20. The illustrated automobile 10—also referred to herein as "motor vehicle" or "vehicle" for short—is merely an exemplary application with which novel aspects and features of this disclosure may be practiced. In the same vein, implementation of the present concepts into a front-engine-layout hood assembly should also be appreciated as a representative application of the novel aspects and features disclosed herein. As such, it will be understood that aspects and features of this disclosure may be integrated into various types of engine and hood layouts, applied to other compartment closure assemblies, and implemented for any logically relevant type of motor vehicle. As an example, it is envisioned that the disclosed latch assemblies be integrated into multi-latch tailgate and liftgate systems of pickup trucks and sport utility vehicles. Lastly, the drawings presented herein are not necessarily to scale and are provided purely for instructional purposes. Thus, the specific and relative dimensions shown in the drawings are not to be construed as limiting.

Engine hood assembly 18 of FIG. 1—provided as a representative example of a vehicle compartment closure assembly—is pivotally mounted to one or more load-bearing frame members of the vehicle body 12 to provide access to and securely close the top portion of the engine compartment 20. For instance, the hood assembly 18 may be pivotally mounted via a pair of dual-point hinges with pneumatic cylinder actuators to the lateral engine compartment rails (not visible in the views provided) of the vehicle body 12. The vehicle 10 is equipped with a latch and lock system that employs a concealed latch mechanism 22 to secure the engine hood assembly 18 in a closed position, as shown in FIG. 1. A latch release mechanism 24, shown located inside the passenger compartment, e.g., underneath the steering column or adjacent the driver seat frame, includes a lever, a button, a switch, or other user interface that is pulled, pressed or otherwise activated to disengage the latch mechanism 22 such that the hood assembly 18 can be manually or automatically opened. In a mechanical system architecture, pulling on a release lever of the release mechanism 24 will apply a tensile force to a latch release cable 26. The loaded release cable 26, which may be a Bowden-type cable, activates and thereby disengages the latch mechanism 22 at the front end of the engine hood assembly 18 opposite the hinge mount. This allows the hood assembly 18 to be moved to an open position, e.g., under the biasing force of the pneumatic cylinders. Other mounting and latching architectures, including mechanical, electrical, and electro-mechanical configurations, are envisioned as being within the scope of this disclosure. For instance, the schematically illustrated release cable 26 of FIG. 1 may be representative of an electrical wire harness or fiber optic cable, e.g., in applications where the latch mechanism 22 is configured as an electronically actuated ("power") latch assembly.

Presented in the inset view of FIG. 1 is a representative latch mechanism 22 for regulating the opening and closing of the compartment closure assembly 18. The representative latch mechanism 22 is provided with a rigid, robust and corrosion-resistant latch housing that is generally composed of a housing frame plate 28 and a mounting bracket 30. Mounting bracket 30 of FIG. 1 may be rigidly coupled to the housing frame plate 28, e.g., via one or more mechanical interfaces, such as one or more shared swing posts (swing posts 54 and 56) or shoulders (shown schematically at 32). Housing frame plate 28, in turn, is mechanically coupled, e.g., via one or more suitable fasteners, such as flanged hex-head nuts 34, to the vehicle body 12 to provide functional mounting support for the entire latch mechanism 22. According to the illustrated design, for example, the latch mechanism 22 may be rigidly mounted via housing frame plate 28 to an upper tie bar cross-member 36 of the vehicle body 12, generally concealed within the engine compartment 20 underneath the hood assembly 18. It may be desirable that the constituent parts of the latch mechanism 22 be constructed of a strong yet lightweight material, such as thermoplastic polymers and other rigid plastic materials, or aluminum, steel and other metals, or combinations thereof. Clearly, the shape, size, and/or number of housing parts may be modified, for example, to accommodate packaging and design requirements for different vehicle platforms.

The latch housing, including housing frame plate 28 and mounting bracket 30, is constructed to mount and protect various collaboratively configured components that interact to selectively couple a forkbolt 40 to a striker 38 in order to securely latch close the engine hood assembly 18 and, when desired, to selectively decouple the striker 38 from the forkbolt 40 in order for the engine hood assembly 18 to be opened. In particular, engagement and disengagement between the forkbolt 40 and striker 38 are generally achieved through cooperative operation between the forkbolt 40, a detent lever (shown hidden at 42 in FIG. 1) laterally spaced from the forkbolt 40, a release lever 44 underneath the detent lever 42, and a memory lever 46 laterally spaced from the release lever 44, as will be described in extensive detail hereinbelow. Functional support for the forkbolt 40, detent lever 42, release lever 44, and memory lever 46, as well as multiple biasing members 48, 50 and 52 and an ajar switch 39, is provided by the housing frame plate 28, the mounting bracket 30, or both. While not per se required, the forkbolt 40, detent lever 42, release lever 44, and mounting bracket 30 are shown generally sandwiched between the housing frame plate 28 and the memory lever 46, while the forkbolt 40, detent lever 42, and release lever 44 are shown generally coplanar to one another and generally sandwiched between the housing frame plate 28 and the mounting bracket 30. As such, when referencing the various views in the Figures, some or all of the forkbolt 40, detent lever 42, and release lever 44 may be hidden behind the mounting bracket 30 and/or the memory lever 46.

Figure 4:
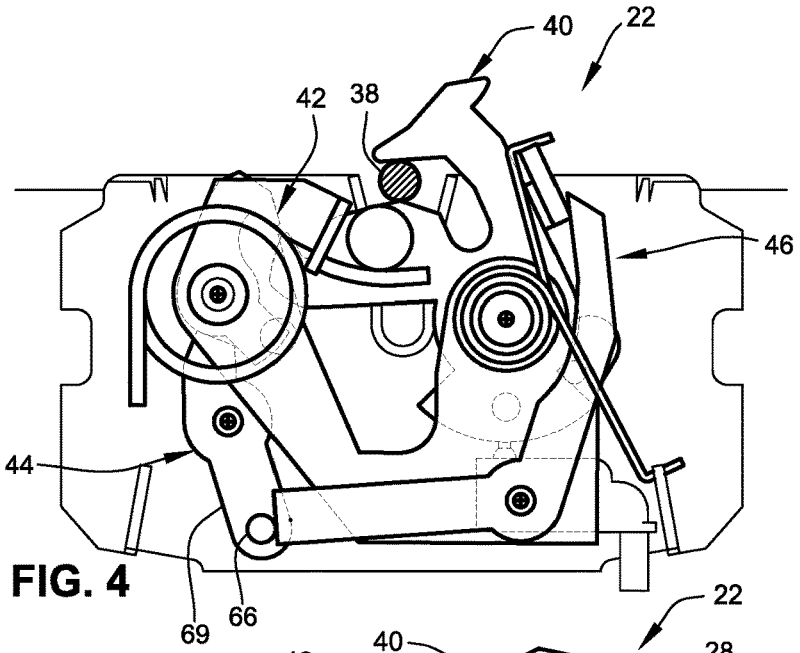
FIG. 4 is a front perspective-view illustration of the representative dual-pull latch assembly of FIG. 1 shown in a memory function condition.
Figure 5:
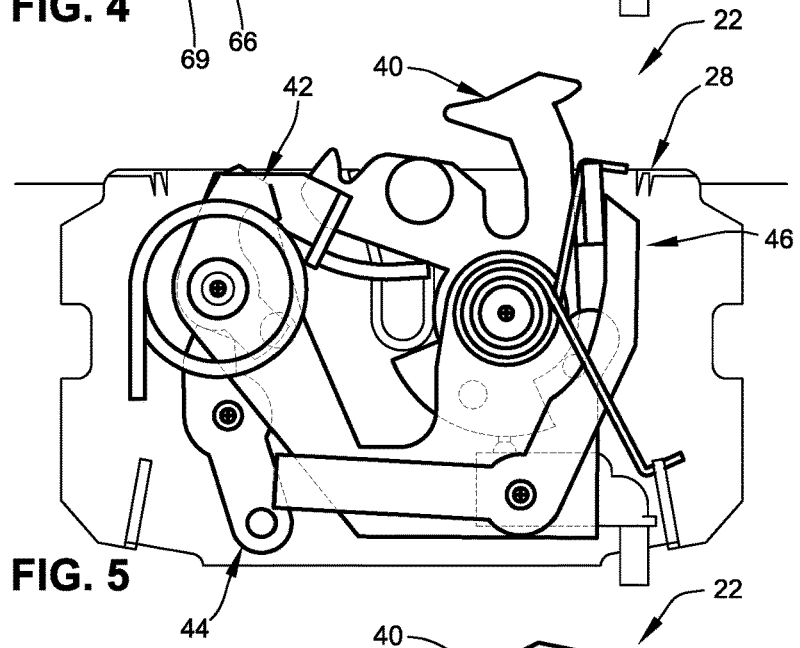
FIG. 5 is a front perspective-view illustration of the representative dual-pull latch assembly of FIG. 1 shown in a memory cancel condition.
Figure 6:
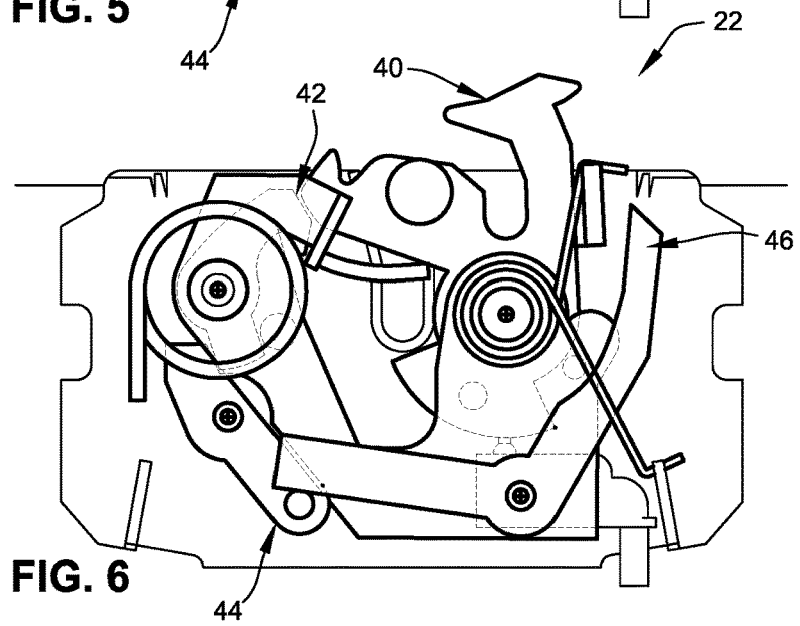
FIG. 6 is a front perspective-view illustration of the representative dual-pull latch assembly of FIG. 1 shown in an open condition.

With continuing reference to FIG. 1, it is seen that the housing frame plate 28 is fabricated with a fish mouth opening 35 through which a pin or bolt of striker 38 is received and escapes when the engine hood assembly 18 is drawn closed and open, respectively. Controlled movement of the forkbolt 40 relative to the housing frame plate 28 functions to capture the striker 38 within an arcuate throat 41 of the forkbolt 40, whereby the striker 38 is held at multiple distinct locations within the fish mouth opening 35. By way of example, and not limitation, forkbolt 40 may be pivotally mounted to the housing frame plate 28 and mounting bracket 30, e.g., via a cylindrical swing post 54, to selectively rotate about a first axis A1 from a first (fully latched) position (FIG. 1), through a second (initial pop-up) position (FIG. 2) and then a third (secondary pop-up) position (FIG. 3), to a fourth (fully open) position (FIG. 6). When transitioning between the secondary pop-up position (FIG. 3) and the full open position (FIG. 6), the forkbolt 40 may also transition between a fifth (memory function) position (FIG. 4) and a sixth (memory cancel) position (FIG. 5). The forkbolt 40 is also operable to selectively rotate from the fourth position (FIG. 6) to the first position (FIG. 1), as well as to selectively rotate back-and-forth between and/or stop at any of the above-enumerated positions.

When the forkbolt 40 is in the fully latched position of FIG. 1, a proximal segment 43 of the forkbolt throat 41, i.e., the segment that is closest to the swing post 54, receives and captures the striker 38 at a first (lower-most) location within the fish mouth opening 35. By this means, the compartment closure assembly 18 is secured against the vehicle body 12 in the closed position. Comparatively, when the forkbolt 40 transitions to and stops at the initial pop-up position, a medial segment 45 (FIG. 2) of the forkbolt throat 41, which is adjoined to and interposed between the proximal segment 43 and a distal segment 47, receives and captures the striker 38 at a second (intermediate) location within the fish mouth opening 35. In this manner, the forkbolt 40 latches the compartment closure assembly 18 in a primary pop-up position. On the other hand, when the forkbolt 40 transitions to and stops at the secondary pop-up position, the distal segment 47 (FIG. 3) of the forkbolt throat 41, i.e., the segment that is furthest from the swing post 54, receives and captures the striker 38 at a third (upper-most) location within the fish mouth opening 35, thereby latching the compartment closure assembly 18 in an ancillary pop-up position. At the fully open position of FIG. 6, the striker 38 escapes from the forkbolt throat 41 and fish mouth opening 35; in so doing, the forkbolt 40 releases the striker 38 such that the engine hood assembly 18 may be swung open.

Figure 2:
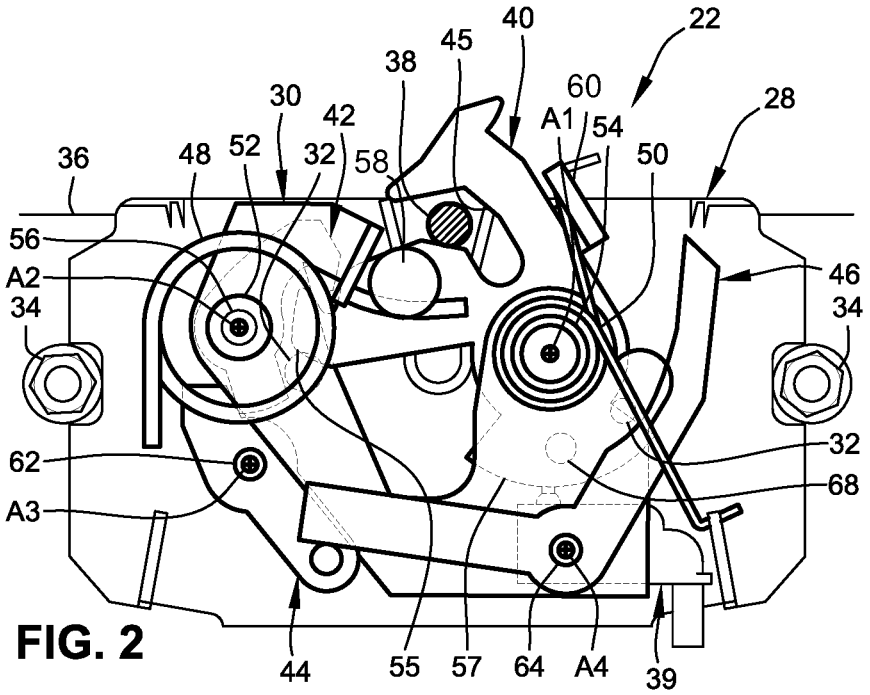
FIG. 2 is a front perspective-view illustration of the representative dual-pull latch assembly of FIG. 1 shown in an initial pop-up condition.
Figure 3:
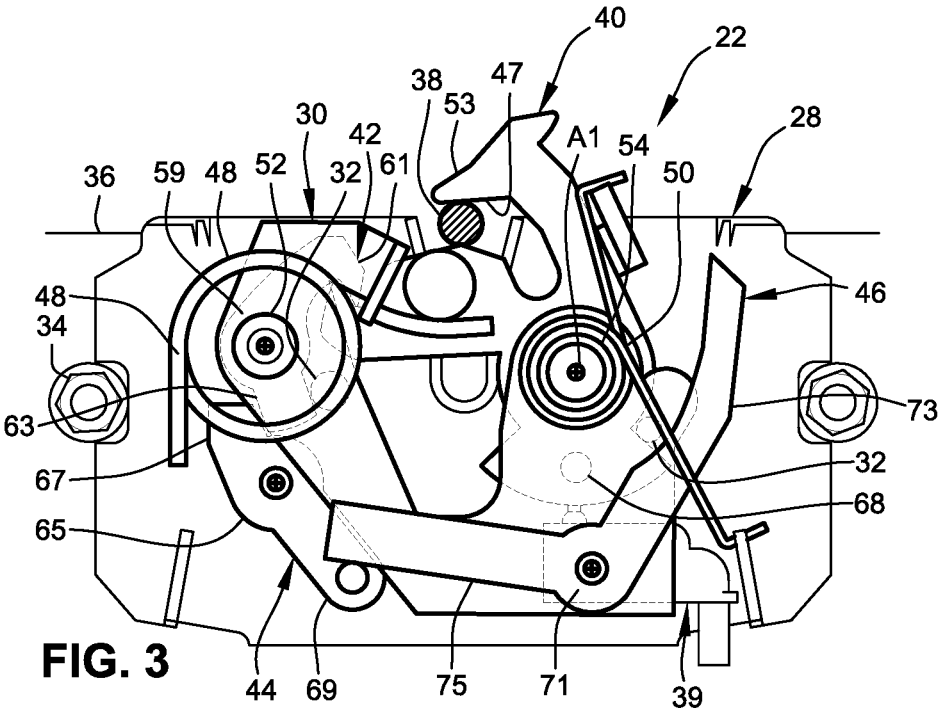
FIG. 3 is a front perspective-view illustration of the representative dual-pull latch assembly of FIG. 1 shown in a secondary pop-up condition.

According to the illustrated example, forkbolt 40 is fabricated as a single-piece, unitary structure with a forkbolt hub 51 (FIG. 2) that rotatably mounts onto the swing post 54, a primary latch hook 53 (FIG. 3) that projects radially outward from a first discrete location of the forkbolt hub 51, and a secondary latch hook 55 (FIG. 1) that projects radially outward from a second discrete location of the forkbolt hub 51. With this configuration, the arcuate throat 41 of the forkbolt 40 is defined between the primary and secondary latch hooks 53, 55, with the distal segment 47 of the throat 41 opening at the distal tip of the secondary latch hook 55 and the proximal segment 43 terminating at the forkbolt hub 51. Primary latch hook 53 engages the detent lever 42 when the forkbolt 40 is in the first position, as shown in FIG. 1, whereas secondary latch hook 55 engages the detent lever 42 when the forkbolt 40 is in the third position, as best seen in FIG. 3. Conversely, both hooks 53, 55 are disengaged from the detent lever 42 when the forkbolt 40 is in the second and fourth positions, as shown in FIGS. 2 and 6. An arcuate blade 57 (FIG. 2) is integrally formed with and projects radially outward from the forkbolt hub 51 to activate the ajar switch 39, e.g., in a continuous manner when the forkbolt 40 is in and transitions between the second, third, fourth, fifth and sixth positions.

First biasing member 48, which is portrayed in the drawings as a helical torsion spring, presses against a first forkbolt pin 58 (FIG. 2) that projects generally orthogonally from the secondary latch hook 55 of the forkbolt 40. When the detent lever 42 is disengaged from the primary latch hook 53, e.g., via a first activation of the release mechanism 24 of FIG. 1, the first biasing member 48 (or "pop-up spring") applies a torque to the first forkbolt pin 58, whereby the forkbolt 40 is biased from the fully latched position to the initial pop-up position. When the forkbolt 40 reaches the initial pop-up position, the first biasing member 48 is received in and presses against a (pop-up) flange 31 (FIG. 1) that is integrally formed with the mounting bracket 30; this flange 31 obstructs further movement of the biasing member 48 and, thus, stops the forkbolt 40 at the initial pop-up position. At this juncture, a second biasing member 50, which may also be configured as a helical torsion spring, presses against a forkbolt flange 60 (FIG. 2) that projects generally orthogonally from the primary latch hook 53 of the forkbolt 40. After stopping at the initial pop-up position, the second biasing member 50 (or "forkbolt spring") applies a torque to the forkbolt flange 60, whereby the forkbolt 40 is biased from the initial pop-up position to the secondary pop-up position. The detent lever 42 then engages the secondary latch hook 55, e.g., upon deactivation of the release mechanism 24. When the detent lever 42 is disengaged from the secondary latch hook 55, e.g., via a second activation of the release mechanism 24, the second biasing member 50 presses against the forkbolt flange 60 and moves the forkbolt 40 through the memory function and memory cancel positions of FIGS. 4 and 5 to the fully open position of FIG. 6.

Movement of the forkbolt 40 back-and-forth between the six distinct positions enumerated above is regulated through collaborative operation of the detent lever 42, release lever 44, and memory lever 46. Detent lever 42, for example, is shown pivotally mounted, e.g., via a cylindrical swing post 56, to the housing frame plate 28 and mounting bracket 30, situated adjacent the forkbolt 40 and detent lever 42. Under the biasing force of the third biasing member 52, which is portrayed as a helical torsion spring, the detent lever 42 selectively rotates about a second axis A2 (in a counterclockwise direction in FIG. 1) from a locked position (FIGS. 1 and 3) and an unlocked position (FIGS. 4 and 5). As shown, the illustrated detent lever 42 is fabricated as a single-piece, J-shaped structure with a detent hub 59 (FIG. 3) that rotatably mounts onto the swing post 56, a detent hook 61 that is integrally formed with and projects radially outward from a first discrete location of the detent hub 59, and an elongated stem 63 that is integrally formed with and projects radially outward from a second discrete location of the detent hub 59. Detent hook 61 engages the primary latch hook 53 when the forkbolt 40 is in the first position and the detent lever 42 is in the locked position, as shown in FIG. 1. When the forkbolt 40 is in the second position, the detent hook 61 is displaced slight upwardly from the secondary latch hook 55 such that the detent lever 42 is disengaged from the forkbolt 40, as best seen in FIG. 2. Between the first and second forkbolt positions, the secondary latch hook 55 of the forkbolt 40 may engage the lower stem portion 63 of the detent 42 to momentarily stop the forkbolt 40 during its rotation towards the third position. Detent hook 61 then engages the secondary latch hook 55 when the forkbolt 40 transitions to the third position while the detent lever 42 is in the locked position, as shown in FIG. 3. Detent hook 61 then disengages both latch hooks 53, 55 such that the forkbolt 40 may transition from the third secondary pop-up position to the fully open fourth position, as shown in FIGS. 4-6. At the fully open position, the backside (left-side sloped surface in FIG. 6) of the secondary latch hook 55 may rest on top of the backside (right-side sloped surface in FIG. 6) of the detent hook 61.

The release lever 44 generally functions to selectively reposition the detent lever 42 and, thus, the forkbolt 40 in response to inputs from a driver of the vehicle 10. In accord with the illustrated example, release lever 44 is fabricated as a single-piece, oblong body with a release hub 65 (FIG. 3) that rotatably mounts, e.g., via pivot pin 62 (FIG. 1), onto the housing frame plate 28. A first (escapement) arm 67 is integrally formed with and projects radially outward from a first side of the release hub 65, whereas a second (cable) arm 69 is integrally formed with and projects radially outward from a second side of the release hub 65, opposite that of the first side. The release lever's cable arm 67 is mechanically coupled, e.g., via a cable anchor (not shown), to the latch release cable 26 and, thus, to the release mechanism 24. In response to activation of the release mechanism 24, the release lever 44 is pulled by the release cable 26 to rotate (e.g., in a clockwise direction in the Figures) about a third axis A3 from a released position (FIGS. 1-3 and 6) to a pulled position (FIGS. 4 and 5), in which the release lever 44 urges the detent lever 42 from the locked position to the unlocked position. Upon deactivation of the release mechanism 24, a helical return spring or other biasing member (e.g., detent spring 52) pulls the release lever 44 (e.g., in a counterclockwise direction in FIG. 1) to the released position (FIGS. 1, 3 and 6), whereat the release lever 44 releases the detent lever 42, and the detent lever 42 returns to the locked position, as described above.

With reference once again to FIG. 1, the memory lever 46 is pivotally mounted, e.g., via a dedicated pivot pin 64, to the mounting bracket 30, situated adjacent the forkbolt 40 and detent lever 42 for direct engagement therewith. For at least some applications, the memory lever 46 is fabricated as a single-piece, L-shaped structure with a memory hub 71 (FIG. 3) that rotatably mounts to the mounting bracket 30, a first (upper) control arm 73 that is integrally formed with and projects from a first discrete location of the memory hub 71, and a second (lower) control arm 75 that is integrally formed with and projects generally orthogonally from a proximal end of the stem 63. The memory lever 46 selectively rotates about a fourth axis A4 (FIG. 1) between a releasing position (FIGS. 1-3, 5 and 6) and a catching position (FIG. 4). According to FIG. 1, the first, second, third and fourth axes A1-A4 are mutually parallel yet distinct from one another. When the memory lever 46 is moved to the catching position, e.g., in a counterclockwise direction in FIG. 5, a distal tip of the lower control arm 75 presses against a release lever pin 66 that projects generally orthogonally from the cable arm 67 of the release lever 44. In so doing, the memory lever 46 prevents the release lever 44 from rotating back to the released position and, thus, "catches" the detent lever 42 in the unlocked position. A second forkbolt pin 68 projects generally orthogonally from the arcuate blade 57, passing through a slot in the mounting bracket 30; this forkbolt pin 68 slidably engages and presses against the upper control arm 73 of the memory lever 46 when the forkbolt returns to the first position of FIG. 1 and thereby moves the memory lever 46 back to its releasing position and generally out of engagement with the release lever 44.

Latch mechanism 22 may be designed to automatically latch the striker 38 into at least the secondary pop-up condition of FIG. 3 under just the weight of engine hood assembly 18 (i.e., without the application of a user-generated closing force). The representative forkbolt 40, for example, may optionally be configured with a memory-lever-cancelling feature that will automatically disengage the memory lever 46 from the release lever 44 so that the release lever 44 and detent lever 42 are free to return to their respective released and locked positions. As indicated above, the forkbolt 40 body is fabricated with a forkbolt flange 60 or similarly suitable structure that projects from a lateral edge of the primary latch hook 53. Collective reference to the sequence of movements illustrated from FIG. 3, through FIGS. 4 then 5, and to FIG. 6 shows that the forkbolt 40 rotates, e.g., in a clockwise direction, from the secondary pop-up position (FIG. 3) to the fully open position (FIG. 6). When the forkbolt 40 passes through the memory function position (FIG. 4) to the memory cancel position (FIG. 5), the forkbolt flange 60 will engage and presses against the first control arm 73 of the memory lever 46 to thereby move the memory lever 46 to the releasing position (FIG. 6). Once in the fully open position of FIG. 6, a ramped surface along the upper edge of the detent hook 61 seats thereon a ramped surface on the lower edge of the secondary latch hook 55, whereby the detent lever 42 buttresses the forkbolt 40 in the fully open position. The spring force of the forkbolt spring 50 is sufficiently large to ensure that the forkbolt 40 will complete its rotation to the fully open position of FIG. 6, yet is sufficiently small to allow the forkbolt 40 to rotate back to the secondary pop-up position when the pin or bolt of the striker 38 is merely laid on the forkbolt 40. For at least some alternative configurations, the memory lever 46 may also be connected, e.g., via a cable or other mechanical linkage, to an external input that is operable to manually or automatically shift the memory lever 46 out of the catching position in the event that the vehicle 10 is shifted out of park and/or reaches a minimum speed threshold.

In accord with aspects of the disclosed concepts, the latch mechanism 22 may be configured such that the forkbolt 40 automatically engages and latches the striker 38 into at least the secondary pop-up position (FIG. 3) if the engine hood assembly 18 has not been lifted after full release, and the vehicle is shifted into drive. Optionally, if the engine hood assembly 18 is set down on the forkbolt 40, the latch mechanism 22 will latch the striker 38 into at least the secondary pop-up position regardless of the park-shift interlock state. These features may be beneficial, for example, for autonomous vehicles to help ensure the engine hood will be at least partially latched in the event the engine hood is inadvertently popped open. As yet another option, a second hood switch may be incorporated to detect movement of the engine hood assembly 18 to the secondary pop-up condition of FIG. 3.

Aspects of the present disclosure have been described in detail with reference to the illustrated embodiments; those skilled in the art will recognize, however, that many modifications may be made thereto without departing from the scope of the present disclosure. The present disclosure is not limited to the precise construction and compositions disclosed herein; any and all modifications, changes, and variations apparent from the foregoing descriptions are within the scope of the disclosure as defined by the appended claims. Moreover, the present concepts expressly include any and all combinations and subcombinations of the preceding elements and features.

What is claimed:

1. A latch mechanism for a compartment closure assembly of a motor vehicle, the motor vehicle including a passenger compartment and a release mechanism, the compartment closure assembly including a striker and being movably mounted to a vehicle body of the motor vehicle to transition between open and closed positions, the latch mechanism comprising:

a detent lever configured to movably attach to the vehicle body and transition between a locked position and an unlocked position;

a release lever configured to operatively attach to the release mechanism and movably attach to the vehicle body to transition between a pulled position, whereat the release lever moves the detent lever to the unlocked position responsive to an activation of the release mechanism, and a released position, whereat the release lever releases the detent lever to move to the locked position responsive to a deactivation of the release mechanism;

a memory lever configured to movably attach to the vehicle body adjacent the release lever and transition, with respect to movement of the release lever, between a catching position, whereat the memory lever engages and catches the release lever in the pulled position, and a releasing position, whereat the memory lever disengages the release lever;

a biasing member configured to attach to the vehicle body; and a forkbolt configured to movably attach to the vehicle body adjacent the detent and release levers and transition between:

a first position, whereat the forkbolt engages the detent lever, retains the striker at a first location, and latches the compartment closure assembly in the closed position;

a second position, whereat the forkbolt displaces away from engagement with the detent lever, retains the striker at a second location distinct from the first location, and latches the compartment closure assembly in a primary pop-up position via the biasing member acting on the forkbolt;

a third position, whereat the forkbolt engages the detent lever, retains the striker at a third location distinct from the first and second locations, and latches the compartment closure assembly in an ancillary pop-up position; and a fourth position, whereat the forkbolt disengages the detent lever and releases the striker such that the compartment closure assembly is movable to the open position.

2. The latch mechanism of claim 1, wherein the forkbolt includes primary and secondary latch hooks, the primary latch hook engaging the detent lever when the forkbolt is in the first position, and the secondary latch hook engaging the detent lever when the forkbolt is in the third position.

3. The latch mechanism of claim 2, wherein the forkbolt further includes a forkbolt body with a forkbolt hub configured to rotatably mount to the vehicle body, and wherein the primary latch hook projects radially outward from a first location of the forkbolt hub, and the secondary latch hook projects radially outward from a second location of the forkbolt hub.

4. The latch mechanism of claim 3, wherein the forkbolt defines an arcuate throat, and wherein the striker is captured inside the throat at the first, second, and third locations.

5. The latch mechanism of claim 4, wherein the forkbolt, including the forkbolt hub, the primary and secondary latch hooks, and the throat, is integrally formed as a single-piece unitary structure.

6. The latch mechanism of claim 1, wherein the memory lever includes a memory hub and first and second control arms, the memory hub configured to rotatably attach to the vehicle body adjacent the forkbolt and the release lever, and the first and second control arms projecting from the memory hub.

7. The latch mechanism of claim 6, wherein the release lever includes first and second lever arms projecting from a rotatable release hub with a release pin projecting from the first lever arm, the second control arm abutting the release pin when the memory lever is in the catching position to thereby catch the release lever in the pulled position.

8. The latch mechanism of claim 6, wherein the forkbolt includes a forkbolt body with a forkbolt pin projecting therefrom, the forkbolt pin abutting the first control arm when the forkbolt is in the first position to thereby move the memory lever to the releasing position.

9. The latch mechanism of claim 8, wherein the forkbolt body includes a forkbolt flange projecting therefrom, the forkbolt flange abutting the first control arm when the forkbolt moves to the fourth position to thereby move the memory lever to the releasing position.

10. The latch mechanism of claim 6, wherein the first control arm projects radially outward from a first location of the memory hub, and the second control arm projects radially outward from a second location of the memory hub to define an L-shaped forkbolt body.

11. The latch mechanism of claim 6, wherein the memory lever, including the memory hub and the first and second control arms, is integrally formed as a single-piece unitary structure.

12. The latch mechanism of claim 1, further comprising a latch housing with a mounting bracket configured to mount to the vehicle body, wherein the forkbolt and the detent lever are rotatably mounted to the mounting bracket.

13. The latch mechanism of claim 12, wherein the biasing member includes a first spring biasing the forkbolt to the second position, wherein the mounting bracket includes a flange configured to abut the first spring and thereby restrict movement thereof.

14. The latch mechanism of claim 13, wherein the biasing member further includes a second spring, distinct from the first spring, biasing the forkbolt to the third and fourth positions.

15. The latch mechanism of claim 1, wherein the forkbolt rotates about a first axis, the detent lever rotates about a second axis, and the release lever rotates about a third axis, the first, second and third axes being mutually parallel and distinct from one another.

16. A method of assembling a latch mechanism for a compartment closure assembly of a motor vehicle, the motor vehicle including a passenger compartment and a release mechanism, the compartment closure assembly including a striker and being movably mounted to a vehicle body of the motor vehicle to transition between open and closed positions, the method comprising:

attaching a detent lever to the vehicle body to move between a locked position and an unlocked position;

attaching a release lever to the release mechanism;

attaching the release lever to the vehicle body to move between a pulled position, whereat the release lever moves the detent lever to the unlocked position responsive to an activation of the release mechanism, and a released position, whereat the release lever releases the detent lever to move to the locked position responsive to a deactivation of the release mechanism;

attaching a memory lever to the vehicle body adjacent the release lever to transition, with respect to movement of the release lever, between a catching position, whereat the memory lever engages and catches the release lever in the pulled position, and a releasing position, whereat the memory lever disengages the release lever;

attaching a biasing member to the vehicle body; and attaching a forkbolt to the vehicle body, adjacent the detent and release levers, to move between:

a first position, whereat the forkbolt engages the detent lever, retains the striker at a first location, and latches the compartment closure assembly in the closed position;

a second position, whereat the forkbolt displaces from engagement with the detent lever, retains the striker at a second location distinct from the first location, and latches the compartment closure assembly in a primary pop-up position via the biasing member acting on the forkbolt;

a third position, whereat the forkbolt engages the detent lever, retains the striker at a third location distinct from the first and second locations, and latches the compartment closure assembly in an ancillary pop-up position; and a fourth position, whereat the forkbolt disengages the detent lever and releases the striker such that the compartment closure assembly is movable to the open position.

17. A motor vehicle comprising:

a vehicle body with a vehicle compartment and a passenger compartment;

a compartment closure assembly movably mounted to the vehicle body to transition between an open position, providing access to the vehicle compartment, and a closed position, obstructing access to the vehicle compartment;

a striker attached to one of the compartment closure assembly or the vehicle body;

a manually activated release mechanism; and a latch mechanism, including:

a mounting bracket attached to one of the vehicle body or the compartment closure assembly;

a detent lever rotatably mounted on the mounting bracket to rotate between a locked position and an unlocked position;

a release lever mechanically coupled to the release mechanism and configured to rotate between a pulled position, whereat the release lever moves the detent lever to the unlocked position responsive to an activation of the release mechanism, and a released position, whereat the release lever releases the detent lever to move to the locked position responsive to a deactivation of the release mechanism;

a memory lever rotatably mounted to the mounting bracket adjacent the release lever to transition between a catching position, whereat the memory lever engages and catches the release lever in the pulled position, and a releasing position, whereat the memory lever disengages the release lever;

a biasing member attached to the vehicle body; and a forkbolt rotatably mounted on the mounting bracket adjacent the detent and release levers, the forkbolt being configured to rotate between:

a first position, whereat the forkbolt engages the detent lever, retains the striker at a first location, and latches the compartment closure assembly in the closed position;

a second position, whereat the forkbolt displaces from engagement with the detent lever, retains the striker at a second location distinct from the first location, and latches the compartment closure assembly in a primary pop-up position via the biasing member acting on the forkbolt;

a third position, whereat the forkbolt engages the detent lever, retains the striker at a third location distinct from the first and second locations, and latches the compartment closure assembly in an ancillary pop-up position; and a fourth position, whereat the forkbolt disengages the detent lever and releases the striker such that the compartment closure assembly is movable to the open position.

18. The motor vehicle of claim 17, wherein the forkbolt includes a forkbolt hub mounted on the mounting bracket, a primary latch hook integrally formed with and projecting radially outward from a first location of the forkbolt hub, and a secondary latch hook integrally formed with and projecting radially outward from a second location of the forkbolt hub, and wherein the primary latch hook engages the detent lever when the forkbolt is in the first position, and the secondary latch hook engages the detent lever when the forkbolt is in the third position.

19. The motor vehicle of claim 17, wherein the memory lever includes first and second control arms projecting radially outward from a memory hub rotatably mounted to the mounting bracket.

20. The motor vehicle of claim 17, wherein the biasing member includes:

a first spring biasing the forkbolt to the second position, wherein the mounting bracket includes a flange configured to abut the first spring and thereby restrict movement thereof; and a second spring, distinct from the first spring, biasing the forkbolt to the third position.

* * * * *